United States Patent [19]

Ciccorelli

[11] 4,454,739

[45] Jun. 19, 1984

[54] RING ROLLING MILL

[75] Inventor: Raffaele Ciccorelli, Turin, Italy

[73] Assignee: HS Hydraulic Systems S.r.l., Turin, Italy

[21] Appl. No.: 365,691

[22] Filed: Apr. 5, 1982

[30] Foreign Application Priority Data

Apr. 13, 1981 [IT] Italy ..... 67506 A/81

[51] Int. Cl.[3] ..... B21H 1/06

[52] U.S. Cl. ..... 72/23; 72/106; 72/110

[58] Field of Search ..... 72/105, 106, 110, 8, 72/23

[56] References Cited

U.S. PATENT DOCUMENTS

| | | | |
|---|---|---|---|
| 2,925,003 | 2/1960 | McMullen | 72/106 |
| 3,824,820 | 7/1974 | Jeuken et al. | 72/110 |
| 3,992,914 | 11/1976 | Connell | 72/106 |
| 4,320,643 | 3/1982 | Yasuda et al. | 72/8 |

*Primary Examiner*—Lowell A. Larson

[57] ABSTRACT

A ring rolling mill comprising a driven working roll, a rotary mandrel serving as a counter-roll, and a containment roller carried by a pivoted arm and able to engage laterally the ring being rolled, further includes a tracer roller carried by a respective pivoted arm. The assembly formed by the tracer roller and its respective arm is a mirror image of the assembly formed by the containment roller and its respective arm across the vertical plane identified by the axes of rotation of the working roll and of the mandrel which are both vertically orientated. Means for detecting the angular position of the tracer arm and of the containment arm are connected to an electrical control circuit of an hydraulic servo valve for regulation and locking of the angular movement of the containment arm so as to maintain the containment roller in a symmetrical position with respect to the tracer roller across the vertical plane.

9 Claims, 4 Drawing Figures

RING ROLLING MILL

Figure 1:
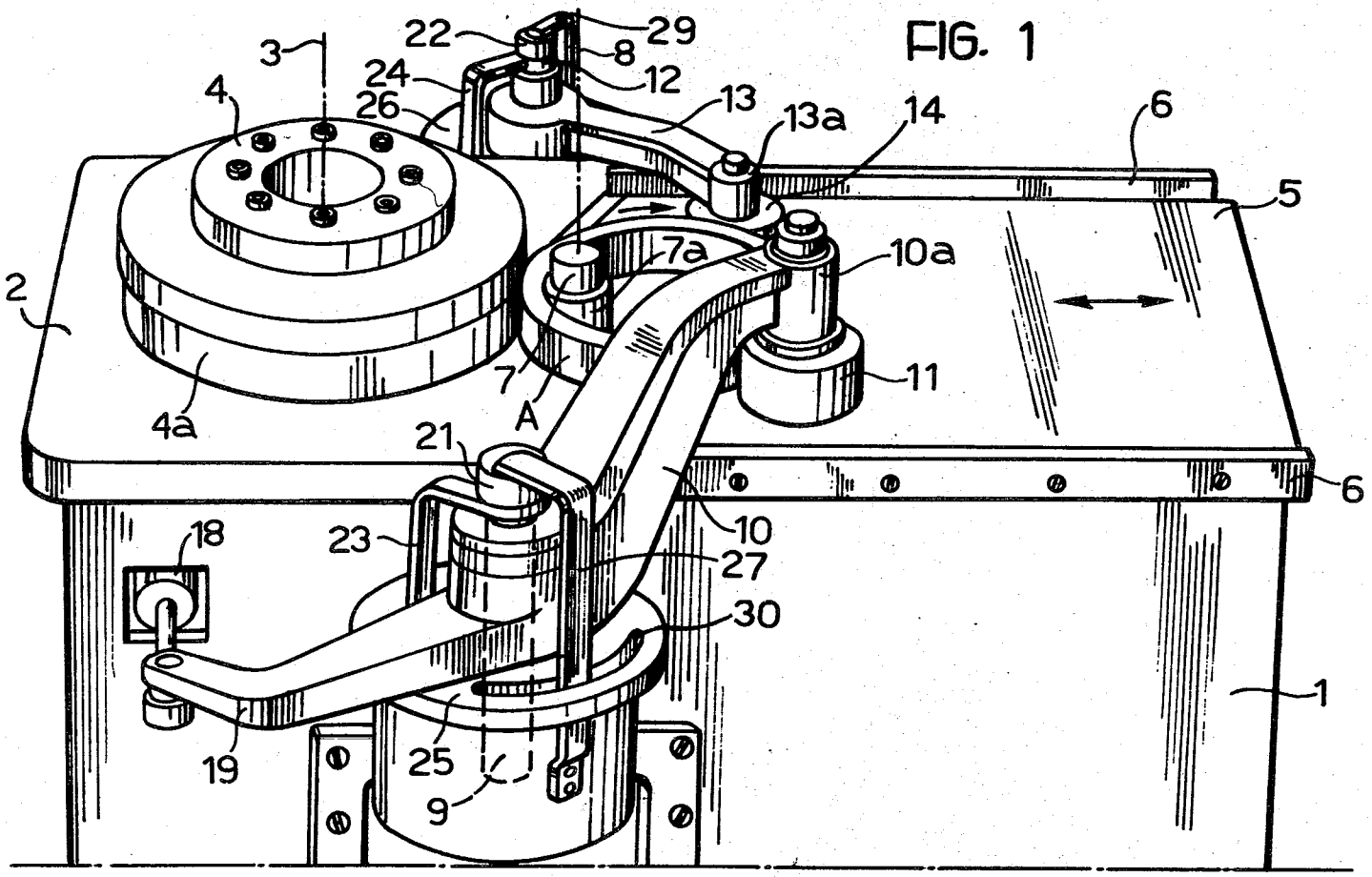

The present invention relates to ring rolling mills of the type comprising:

a driven working roll with a fixed vertical axis, a table movable towards and away from the roll, a vertical-axis rotary mandrel carried by the table and serving as a counter-roll, about which the ring is disposed in such a way that it rests on the table and is rolled between the roll and the mandrel, the axes of the roll and of the mandrel lying in a vertical plane parallel to the direction of movement of the table, a containment roller having a vertical axis and operable to laterally engage the ring during rolling, an arm pivotable about a vertical axis, which carries the said roller at a free end, and means for making the containment arm rotate in such a sense as to displace the containment roller from the said vertical plane gradually as the diameter of the ring increases upon rolling.

In ring rolling mills of the type specified above there is a problem in maintaining the containment roller in engagement with the outer surface of the ring being worked.

In prior art ring rolling mills, the movement of the pivoted arm which carries the containment roller is controlled, by means of a kinematic mechanism including a cam, by the rotation of the working roll. In this way, the displacement of the containment roller is controlled in dependence on the time elapsed from the beginning of the rolling operation. This is unsatisfactory inasmuch as the increase in diameter of the ring by the effects of the rolling does not follow an exact law and can vary within wide limits as a function of the conditions in which the rolling operation is performed, and as a function of the intrinsic characteristics of the material of the ring subject to rolling.

There can thus occur situations in which displacement of the containment roller with respect to the plane identified by the axes of rotation of the working roll and of the mandrel is insufficient, giving rise to conditions of juddering. In other cases the displacement of the containment roller is excessive: the ring is then free to pivot about the position defined by the nip between the working roll and the mandrel acting as counter-roll.

In both the above indicated situations the final product of the rolling operation is defective and must be scrapped.

The object of the present invention is to provide a ring rolling mill of the above identified type, which does not have the above indicated disadvantages.

With a view to achieving this object, the subject of the present invention is a ring rolling mill of the type specified above, characterized by the fact that it includes:

a tracer arm pivoted about a vertical axis which is a mirror image of the said containment arm across the said vertical plane and is resiliently biased towards this plane, a tracer roller having a vertical axis, carried by the said tracer arm and having the same diameter as the containment roller, a pair of angle sensors, each sensitive to the angular position of a respective containment or tracer arm, and a control circuit supplied with signals produced by the angle sensors and operable to control the said means for making the containment arm turn in such a way as to maintain the containment roller in a symmetrical position with respect to the tracer roller across the said vertical plane.

Owing to this characteristic, the containment roller is constantly maintained in lateral engagement with the ring being rolled, preventing the occurrence of the phenomena of juddering or of free oscillation previously described.

Figure 2:
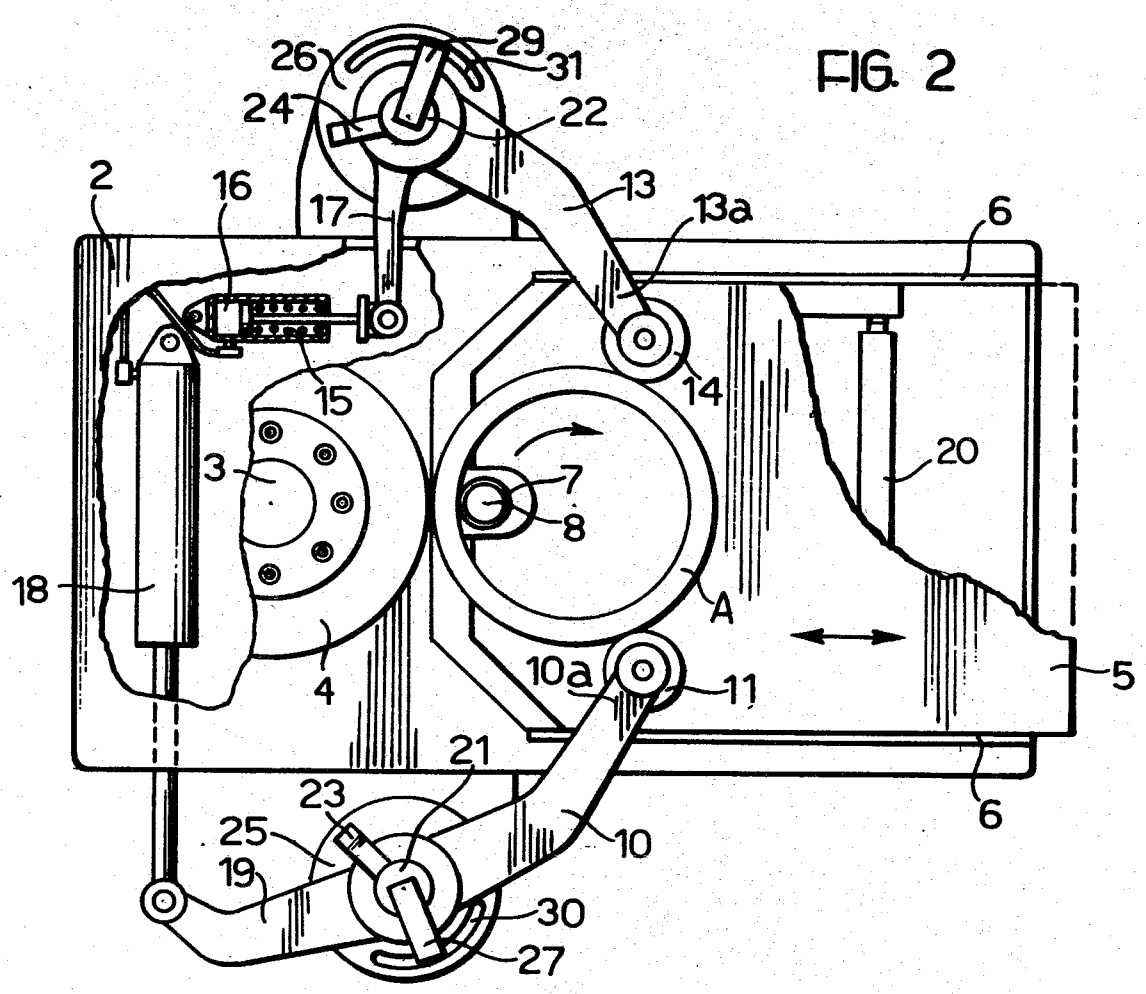
Figure 3:
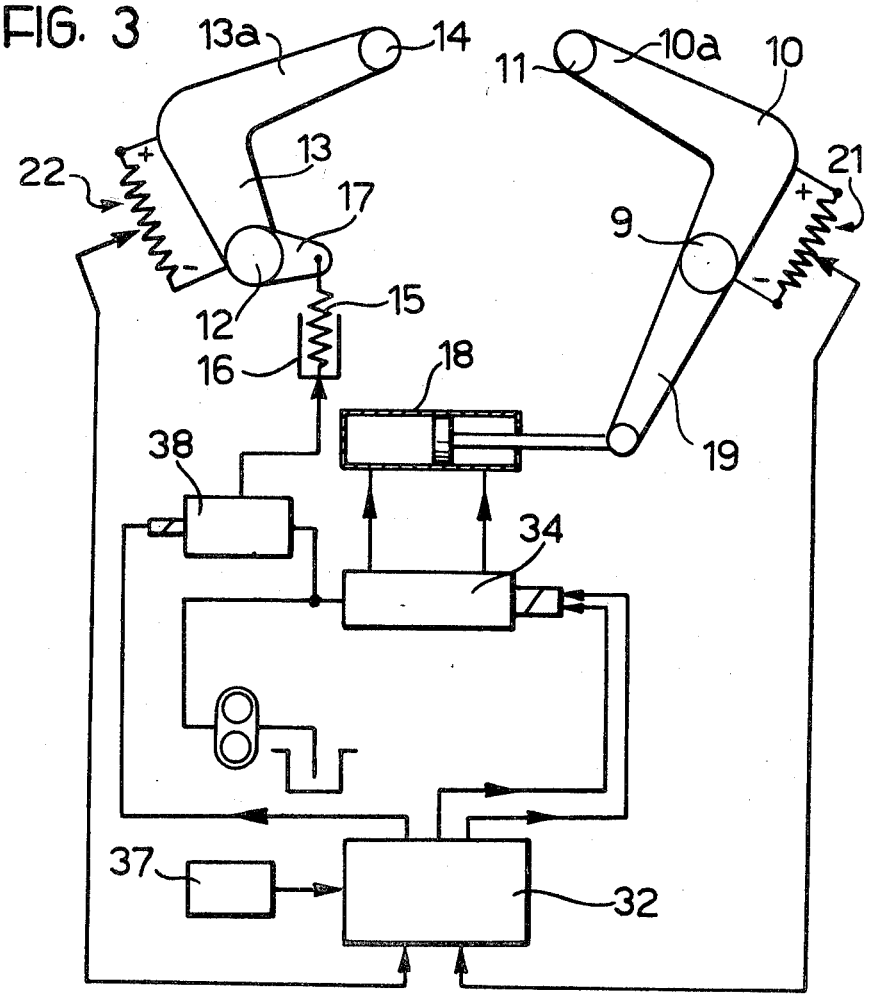
Figure 4:
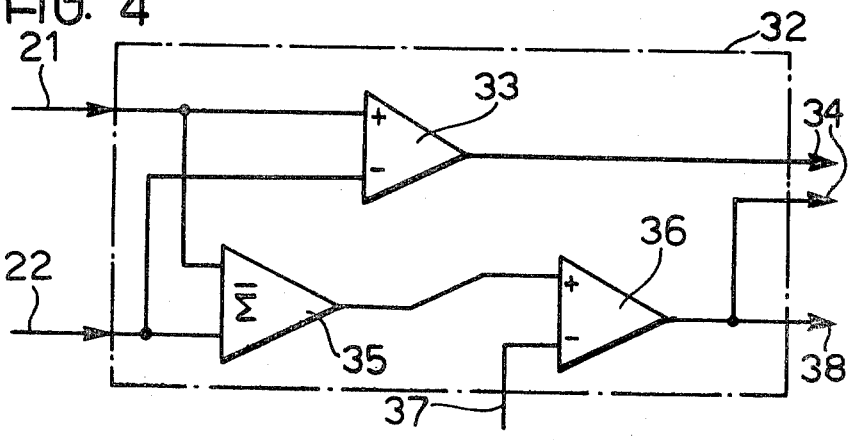

The advantages deriving from the invention will become apparent from the following description, given with reference to the attached drawings provided by way of non limitative example, and in which:

FIG. 1 is a perspective view of the upper portion of the ring rolling mill according to the invention, FIG. 2 is a plan view, partially sectioned, of the rolling mill, FIG. 3 is a schematic representation of the electrical and hydraulic control and regulation system of the rolling mill, and FIG. 4 is a block diagram showing the inner structure of one of the elements of FIG. 3.

In FIG. 1, there is generally indicated a base 1 which carries at its upper end a working plane 2 on which the working roll 4 is rotatably mounted about a vertical axis 3. The working surface 2 includes a table 5 movable towards and away from the roll 4 along a pair of guides 6. The table 5 carries a mandrel 7 freely rotatable about a vertical axis 8. The mandrel 7 serves as a counter-roll in the operation of rolling a ring A disposed about the mandrel 7 and resting on the table 5.

Normally, the lateral surface **4*a* of the working roll 4 and the lateral surface 7*a* of the mandrel 7** have profiles which are respectively complementary to the profiles of the outer and inner surfaces of the ring A.

Mounted about a vertical shaft 9 carried by the support 1 there is a pivoted arm 10 which carries at its free end **10*a* a containment roller 11 operable to engage the ring laterally during rolling. The containment roller 11 acts on the semi-circle of the ring A which, with reference to the direction of rotation of the ring A, is located in advance of the portion of the ring A lying between the roll 4 and the mandrel 7** during the rolling operation which is performed, in the case illustrated, by making the ring A turn in a clockwise sense.

In a mirror image position with respect to the arm 10 and the containment roller 11, across the vertical plane identified by the axes of rotation 3 and 8, there is rotatably mounted, about a shaft 12 carried by the base 1, a second pivoted arm 13 which carries at its free end **13*a* a roller 14 having the same diameter as the containment roller 11** and which serves as a mechanical tracer.

The pivoted arm 13, which carries the tracer roller 14, is resiliently biased in engagement with the ring A being rolled by resilient means constituted by a helical spring 15 contained in a single-acting hydraulic cylinder 16 arranged below the working plane 2 and the piston rod of which is connected with the tracer arm 13 by means of a connecting rod 17.

The force exerted by the spring 15 can be opposed by the action of the hydraulic cylinder 16, which serves to make the arm 13 turn outwardly of the movable table 5 in such a way as to space the tracer roller 14 from the position of engagement with the ring A, for example, to permit the insertion of the ring between the roll 4 and the mandrel 7 at the beginning of the rolling operation.

The turning of the containment arm 10 about the shaft 9 is controlled by a double-acting hydraulic actuator 18 arranged below the working plane 2, by means of an arm 19 rigidly connected with the arm 10 for rotation about the shaft 9.

The rolling mill according to the invention further includes means (not illustrated) for control of the movement in a horizontal sense of the movable table 5 towards and away from the roll 4. In the position of maximum spacing from the roll 4, the table 5 can be tipped up about a horizontal shaft 20 in such a way as to permit automatic discharge of a ring which has been subjected to a rolling operation.

In axially aligned positions with respect to the shafts 9 and 12 there are mounted two angle sensors 21, 22 which are sensitive, respectively, to the angular position of the containment arm 10 and that of the tracer arm 13. In the embodiment illustrated, each angle sensor 21, 22, which can be of the potentiometric type or of the type known in the relevant technical literature as an "angle encoder", comprises a rotary portion connected by means of a respective bracket 23, 24 to a flange 25, 26 rigidly connected with the respective arm 10, 13, and a stator portion connected by means of another bracket 27, 29 with the base 1 of the rolling mill.

Preferably, each of the flanges 25, 26 has arcuate slots 30, 31 traversed by the brackets 27 and 29.

The angle sensors 21, 22 may be provided with angle multipliers, for instance angle multipliers of the gear type.

The electrical signals produced by the angle sensors 21, 22 are supplied to a control circuit 32, having the inner structure shown in detail in FIG. 4.

In FIG. 4, 33 designates a comparator circuit controlling a solenoid valve 34 which acts on the hydraulic actuator 18 to control the movement of the containment arm 10.

As soon as the comparator 33 detects the existence of a difference between the position of the containment roller 11 with respect to the vertical plane identified by the axes of rotation 3 and 8 and the position, with respect to the same plane, of the tracer roller 14, the solenoid valve 34 is acted upon in such a way that the hydraulic actuator 18 re-establishes the conditions of mirror-symmetry of the containment roller 11 and the tracer roller 14 with respect to the said plane.

Preferably, the comparator circuit 33 is of the threshold type with hysteresis for the purpose of preventing the occurrence of uncontrolled oscillation phenomena in the automatic circuit for regulation of the position of the containment arm 10.

By 35 is designated an arithmetic circuit which is supplied with the signals produced by sensors 21, 22 and which produces at its output a signal corresponding to the average of the two input signals.

The average signal provides an indication of the diameter of the ring A being rolled.

It should be pointed out that each one of the signals produced by sensors 21, 22 provides an indication of such diameter, since this diameter is positively identified by the angle formed by each one of the arms 10, 13 with respect to the vertical plane identified by the axes of rotation 3 and 8.

The averaging operation allows however a more precise signal to be obtained which is not influenced by slight dissymmetries which may instantaneously result in the positioning of ring A with respect to the said plane.

The signal produced by circuit 35 is supplied to a threshold circuit 36, where this signal is compared with a signal level corresponding to a diameter value which was previously selected by acting on a potentiometric selector, such as a digital switch 37.

In addition to the solenoid valve 34, the threshold circuit 36 controls a second solenoid valve 38 which acts on the hydraulic cylinder 16 and controls the outward movement of the tracer arm 13.

When the average value of the signals produced by the angle sensors 21, 22 reaches the reference level set in selector 37, the threshold circuit 36 acts on the solenoid valves 34, 38 to cause outward turning of the arms 10, 13 to space the containment roller 11 and the tracer roller 14 from the engagement position with ring A.

At this point the rolling process is terminated and ring A can be removed from table 5.

I claim:

1. A ring rolling mill comprising:

a driven working roll with a fixed vertical axis, a table moveable towards and away from the roll, a rotatable mandrel with a vertical axis carried by the table and serving as a counter-roll, and about which the ring is arranged in such a way that it rests on the table and is rolled between the roll and the mandrel, the axes of the roll and the mandrel lying in a vertical plane parallel to the direction of movement of the table, a containment roller with a vertical axis, operable to laterally engage the ring being rolled, a containment arm pivoted about a vertical axis carrying said containment roller at a free end thereof, and actuating means for making the containment arm turn in the sense such as to displace the containment roller from the said vertical plane gradually as the diameter of the ring increases by the effect of rolling, a tracer arm (13) pivoted about a vertical axis and which is a mirror image of the said containment arm (10) across the vertical plane and is resiliently biased towards this plane, a tracer roller (14) with a vertical axis, carried by the said tracer arm (13) and having the same diameter as the containment roller (11), a pair of angle sensor means (21,22) each sensitive to the angular position, respectively of the containment arm (10) and tracer arm (13) for producing signals indicative of each angular position and a control circuit (32) supplied with the signals produced by the angle sensor means (21,22) and operable to control the said actuating means (34,18) for making the containment arm (10) turn in such a way as to maintain the containment roller (11) in a symmetrical position with respect to the tracer roller (14) across the said vertical plane.

2. A ring rolling mill according to claim 1, characterised by the fact that the said actuating means for making the containment arm (10) turn comprises a double-acting hydraulic actuator (18) for control of the turning of the arm itself, and a servo valve (34) for commutation, regulation and locking of the movement of the actuator (18).

3. A ring rolling mill according to claim 1 or claim 2, further comprising a hydraulic cylinder (16) operable to make the tracer arm (13) turn outwardly of the movable table (5) to space the tracer roller (14) from the engagement position with ring (A).

4. A ring rolling mill according to claim 1, characterised by the fact that the angle sensor means (21,22) are of an electro-mechanical type.

5. A ring rolling mill according to claim 4, characterised by the fact that the angle sensor means (21,22) are of a potentiometric type, are disposed in positions respectively aligned with the pivotal axes of the containment arm (10) and the tracer arm (13), and each include a rotor portion connected by means of a respective bracket (23,24) to a flange (25,26) rigidly connected with an associated arm (10,13) and a stator portion connected by means of another bracket (27,29) to the base (1).

6. A ring rolling mill according to claim 4 or claim 5 characterised in that the angle sensor means (21,22) are provided with angle multipliers of the gear type.

7. A ring rolling mill according to claim 1, characterised by the fact that the control circuit includes a comparator circuit of the threshold type with hysteresis (33).

8. A ring rolling mill according to claim 3, further comprising an arithmetic circuit (35) to produce a signal corresponding to the average value of the signals produced by the angle sensor means (21,22) and a threshold circuit (36) to compare said signal corresponding to the average value with a reference level and by the fact that said threshold circuit (36) acts on said hydraulic actuator (18) and on said hydraulic cylinder (16) for disengaging the containment arm (10) and the tracer arm (13) from the engagement position with the ring (A) when the average value of the signals produced by the angle sensor means (21,22) reaches said reference level.

9. A ring rolling mill according to claim 8, further comprising means (37) for selectively setting said reference level in the threshold circuit (36).

* * * * *